US007047575B2

(12) United States Patent
Last

(10) Patent No.: US 7,047,575 B2
(45) Date of Patent: May 23, 2006

(54) HINGE COUPLING THREE BUOYANT-SLAT POOL COVER SECTIONS

(76) Inventor: Harry J. Last, 1010 Koohoo Pl., Kailua, HI (US) 96734

( * ) Notice: Subject to any disclaimer, the term of this patent is extended or adjusted under 35 U.S.C. 154(b) by 10 days.

(21) Appl. No.: 10/975,625

(22) Filed: Oct. 28, 2004

(65) Prior Publication Data

US 2005/0091735 A1 May 5, 2005

Related U.S. Application Data

(60) Provisional application No. 60/517,246, filed on Nov. 4, 2003, provisional application No. 60/517,053, filed on Nov. 4, 2003, provisional application No. 60/516,664, filed on Oct. 31, 2003.

(51) Int. Cl.
*E04H 4/08* (2006.01)

(52) U.S. Cl. ..... 4/498; 160/229.1

(58) Field of Classification Search ..... 4/498, 4/500–502; 160/133, 185, 220, 228, 229.1, 160/232

See application file for complete search history.

(56) References Cited

U.S. PATENT DOCUMENTS 3,613,126 A * 10/1971 Granderath ..... 4/502
4,063,585 A * 12/1977 Stanley ..... 160/229.1 X
5,067,182 A * 11/1991 Koelsch ..... 4/498

* cited by examiner

*Primary Examiner*—Robert M. Fetsuga
(74) *Attorney, Agent, or Firm*—David E. Newhouse, Esq.

(57) ABSTRACT

An invented hinge for coupling three buoyant-slats pool cover sections together is described wherein three, modified, longitudinal buoyant slats are coupled for pivoting around three angularly spaced, parallel hinge axes aligned with the slats by a plurality of hinge plates each defining a coupling aperture received and pinned within registering hinge bays penetrating into adjacently positioned, longitudinal side flotation chambers of the three modified buoyant slats by a longitudinal hinge pin passing through the coupling apertures of the hinge plates received in the hinge bays inside of the flotation chamber of each of the three modified, buoyant slats. The three modified longitudinal buoyant slats of the assembled hinge present three cooperating coupling structures extending longitudinally along the slat sides opposite the pivot axes of the hinge for coupling a vertical section and two horizontal sections of a buoyant-slat pool cover extending/retracting from an interior, pool bottom cover drum trough where the vertical section extends up and down between the cover drum and the pool surface and the horizontal sections coupled to the end of the vertical section extend/retract in opposite directions across a pool surface.

2 Claims, 4 Drawing Sheets

HINGE COUPLING THREE BUOYANT-SLAT POOL COVER SECTIONS

RELATED APPLICATIONS

This Application relates to and claims the benefits conferred by U.S. Provisional Patent Application Ser. No. 60/516,664 filed Oct. 31, 2003 and Nos. 60/517,053 and 60/517,246 filed Nov. 4, 2003 the entirety of which are incorporated herein by reference.

BACKGROUND OF THE INVENTION

1. Field of the Invention

The invention relates to buoyant-slat automatic pool cover systems, and in particular, to buoyant-slat systems that extend and retract two or more pool cover sections simultaneously.

2. Description of the Prior Art

Covering a swimming pool having an irregular (non-rectangular) shape with a cover formed from longitudinally, interconnected, rigid buoyant-slats typically requires two or more cover sections that emerge from covered troughs located in the interior of the pool below the bottom surface of the pool and extend oppositely to cover the pool. [See EPO 0369038 A1 & B1, R. Granderath, and DE 19807576 A1, K. Frey.]. Descriptions of typical buoyant slats for such pool cover systems are described in U.S. Pat. No. 4,577,352, Gautheron, and in. U.S. Pat. No. 5,732,846, Helge, Hans-Heinz (See also DE 4101727 and EPO 225862 A1.)

In more detail, a typical solar buoyant-slat for a pool cover has a transparent upper or top surface and a dark bottom or undersurface (See U.S. Pat. No. 5,732,846, Helge, col. 1, 11 27–34). Each slat is an extruded plastic tube with two or more stoppered, air filled longitudinal flotation chambers having a longitudinal male, prong hook along one side and a cooperating, longitudinal female prong-receiving channel along its other side [See FIGS. 1 & 2]. Pluralities of such slats are interleaved together to form a flexible or rollup-able cover. Buoyant pool cover slats are also quite vulnerable to over heating, i.e., heat increases air pressure trapped in the flotation chambers that can compromise the water tightness of the slat. Water convection cools the dark undersides of solar slats forming the cover when the cover is deployed on a pool surface.

The couplings between adjacent coupled slats are essentially a loose, longitudinal, bidirectional hinge that is flexible or bendable back and forth around the longitudinal coupling typically allowing a 30° topside flex and a 45° underside flex with reference to the horizontal plane of the cover floating on a pool surface. The degree of topside and underside flexibility of the coupling between adjacent buoyant slats cover affects both the direction the cover is wound and the minimum diameter of the cover drum. The minimum radius of curvature of such flexed buoyant-slat covers ranges from 4 to 6 inches depending on whether the direction of the flex is in a topside or underside direction.

Accordingly, when two sections of a buoyant-slat pool cover deploy from a cover drum submerged in a trough in the interior of the bottom pool for extending to opposite ends of a pool, a transverse area of the pool between the oppositely extending elements will not be covered due to radii of curvature of the respective flexed regions of the cover sections curving from a vertical orientation extending up from the submerged cover drum to a horizontal orientation floating on the pool surface. [See EPO 0369038 A1, R. Granderath, FIG. 2 at 33.] A separate buoyant section deployed for guiding and then bridging between two cover sections deployed from separate cover drums proposed by K Frey in DE19807576 A1 is simply impracticable, and unnecessarily complicates automation of such systems.

Other complications of covering irregularly shaped, or non-rectangular swimming pools with two or more sections of a buoyant-slat pool cover relate to safety. In particular, the buoyant-slats forming the cover sections are not easily anchored to the pool walls particularly when the leading tongue sections of the cover are not as wide as the body of the cover. Unanchored, buoyant-slat pool covers floating on a pool surface, while presenting an appearance of a seemingly stable, supportive surface, cannot stably support surface loads, and as such present a concealed hazard or trap. Providing safety structures within the pool volume such as edge recesses or railings just below the pool surface along the ends of a pool for allowing capture and anchoring of the cover front end(s), and along the pool sides for laterally supporting the floating buoyant-slats of the pool cover once fully deployed over the pool surface enables buoyant-slat covers to stably support surface loads, hence increases the safety of such systems. [See U.S. Pat. No. 3,613,126 R. Granderath at FIG. 4.] However, such pool side edge railing located just below the pool surface in irregularly, non-rectangular pools, would mechanically preclude retraction and buoyant deployment of buoyant-slat covers having any section wider than the distance between the railings from an interior pool bottom trough below the railings. Edge recesses along the sides of a pool for supporting the ends of buoyant slats forming a pool cover require accommodating interior vertical recesses in the poolside walls to allow retraction and deployment of the cover from an interior, pool bottom trough. Even then, the ends of the buoyant slats of a fully deployed cover spanning across the pool at the vertical sidewall recesses would not be supported. In short, interior poolside wall structures enhancing safety of rigid, buoyant-slat pool covers deploying from interior, pool bottom troughs must be designed to accommodate and allow for buoyant deployment as well as retraction of the widest regions of the respective buoyant-slat pool cover sections.

Finally, permitting tail sections of two oppositely extending sections of a buoyant-slat pool cover to remain submerged below the pool surface when the cover is fully deployed is neither feasible nor safe. In particular, such submerged tail sections would extend down from the pool surface adjacent each other toward the cover drum in the interior, pool bottom trough. Tensioned by buoyancy, such submerged adjacent, vertically oriented tail sections present a vertical crease that not only can easily entrap a person absent lateral support, but also, regardless of lateral support, that will entrap debris collecting, blown or left on the cover surface, e.g., leaves, towels, shoes, and clothing. Such entrapped debris would not be easy to remove from such a vertical crease without disassembling the cover because of tensioning by buoyancy forces.

SUMMARY OF THE INVENTION

An invented hinge for coupling three buoyant-slats pool cover sections together is described wherein three, modified, longitudinal buoyant slats are coupled for pivoting around three angularly spaced, parallel hinge axes aligned with the slats by a plurality of apertured hinge plates each received and pinned within registering hinge bays penetrating into adjacently positioned, longitudinally aligned side flotation chambers of the three modified buoyant slats by a longitudinal hinge pin passing through the coupling apertures of the hinge plates received in the hinge bays inside of the side flotation chamber of each of the three modified, buoyant slats. The three modified longitudinal buoyant slats of the assembled hinge present three cooperating coupling structures extending longitudinally along the slat sides opposite the hinge for coupling a vertical section and two horizontal sections of a buoyant-slat pool cover extending/retracting from an interior, pool bottom trough where the vertical section extends up and down between the cover drum and the pool surface and the horizontal sections extend/retract in opposite directions on a pool surface.

A primary novel aspect of the invented hinge is that it may be fabricated by modifying typical pool cover buoyant slats preferably by cutting off or removing the longitudinal, coupling prong along one side of the slat and then cutting uniformly spaced, hinge bays penetrating perpendicularly into the prong-side flotation chambers of the slats. A hinge plate having a coupling aperture is then placed in each hinge bay of a first so modified buoyant slat with a portion of the coupling aperture extending into the prong-side flotation chamber. A first longitudinal hinge pin, inserted via openings through the ends of the prong-side flotation chamber of that slat, is then passed through the portion of the coupling aperture of each hinge plate received within each hinge bay inside the flotation chamber pinning the hinge plate to the slat. Then a second so modified buoyant slat is aligned along side of the first modified buoyant slat with its uniformly, spaced hinge bays receiving the hinge plates pinned to the first slat so that a portion of the coupling apertures through the hinge plates extends into the flotation chamber of that second so modified buoyant slat. A second longitudinal pin, similarly inserted via openings in the ends of the prong-side flotation chamber of the second modified buoyant slat, is passed through the portion of the coupling aperture of each hinge plate received within each hinge bay inside the flotation chamber of the second modified buoyant slat pivotally coupling the first and second modified buoyant slats together. A third so modified buoyant slat is then aligned adjacent along the juncture of the pinned together first and second of the so modified buoyant slats with its uniformly, spaced hinge bays also receiving the hinge plates, this time with a portion of the coupling aperture vertically spaced from the portions through which the first and second longitudinal pins pass, extending into the flotation chamber of that third modified buoyant slat. A third longitudinal pin, similarly inserted via openings in the ends of the prong-side flotation chamber of the third modified buoyant slat is passed through the respective vertical spaced portions of coupling apertures of the hinge plates inside the flotation chamber of the third modified buoyant slat pivotally coupling the first, second and third modified buoyant slats together. Upon assembly, the invented hinge provides a pivotal coupling with three angularly spaced, parallel hinge axes, adapted to be coupled, by the remaining longitudinal prong-receiving channel of the three so modified, longitudinal buoyant slats, to three separate buoyant-slat pool cover sections that can deploy and retract in three different directions, each independently pivotable about a separate, angular spaced, but parallel axis aligned with the longitudinal slats forming the cover.

The three angularly spaced, parallel hinge axes of the invented hinge permit two oppositely extending/retracting horizontal buoyant-slat pool cover sections to horizontally float flat on a pool surface when fully deployed eliminating any tail section vertical crease between the deployed horizontal cover sections. An added benefit is that the invented hinge allows the oppositely moving horizontal pool cover sections floating fully deployed on the pool surface to be tensioned and anchored increasing its surface load carrying capacity by mechanically, pulling on and anchoring the leading front edges of the oppositely extended, floating horizontal cover sections at the opposite ends of the pool.

Another advantage is that the underwater, vertical extending/retracting section of the buoyant-slat cover coupled to the two oppositely extending horizontal section of the cover by the invented hinge can be narrower than the horizontal sections, thus enabling automatic deployment of safety rail sections along the pool sides above the pool bottom cover drum trough after the cover is fully deployed covering the pool surface complementing existing poolside safety rails systems located just below the pool surface for supporting the ends of the buoyant slats of the deployed pool cover.

Finally, because the invented hinge maybe less buoyant than the adjacent buoyant slats of the horizontal pool cover sections coupled to it, the submerged section of a buoyant-slat cover beneath the hinge extending down coupled to the pool bottom cover drum trough can be extended slightly so that those buoyant slats buoy the hinge to the water surface.

DESCRIPTION OF PREFERRED AND EXEMPLARY EMBODIMENTS

Figure 1:
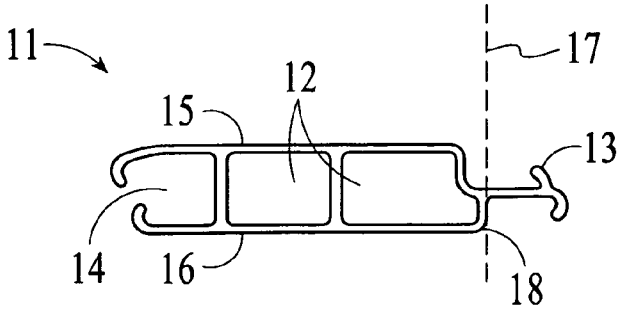
FIGS. 1 & 2 illustrate cross sections of typical "Helge" buoyant pool cover buoyant slat extrusions and how they coupled together.
Figure 2:
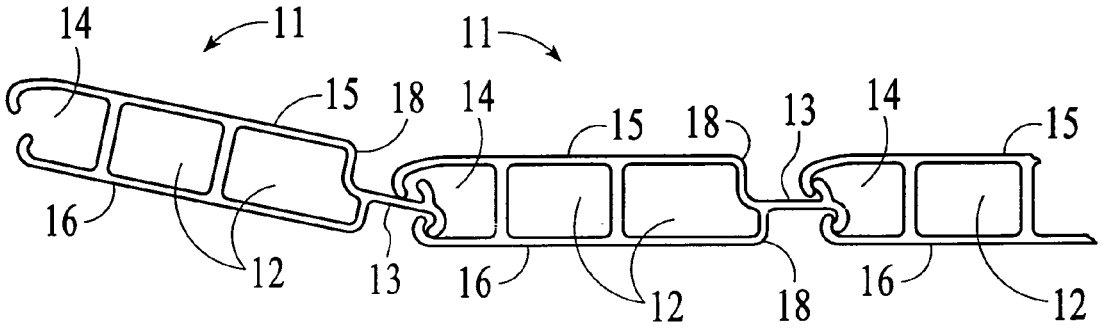

Looking at FIGS. 1 and 2 a typical longitudinal, buoyant pool cover slat 11 comprises an extruded plastic tube having one or more longitudinal flotation chambers 12, with a longitudinal prong 13 along one side, and longitudinal female prong-receiving channel 14 along the opposite side. The extruded tubes are cut in lengths appropriate for spanning a pool surface and the ends stoppered (not shown) trapping air within the flotation chambers 12 [See U.S. Pat. No. 5,732,846, Helge]. The bottom surfaces 16 of solarized slats 11 are typically dark and opaque while the top surface 15 is transparent. This allows for solar heating of a covered pool, with water convection cooling the dark undersurface 16 to prevent over heating compromising water tightness due to trapped air and materials expansion. The longitudinal male prongs of the slats 11 are interleaved into the cooperating longitudinal female prong-receiving channels 14 of adjacent slats 11 for forming a flexible cover that can be wound around a cover drum.

The longitudinal junctions or couplings between adjacent slats 11 are not snug, but rather, are loose allowing the prongs 13 to move transversely within the female prong-receiving channels 14. This enables adjacent coupled slats 11 to flex around the longitudinal coupling relative to each other. With reference to a horizontal 'flotation' plane of a buoyant-slat pool cover, the male prongs 13 and female prong-receiving channels 14 of the slats 11, as presently designed, typically allow for topside flexure above such horizontal reference plane, upward of approximately 30°, and for underside flexure below such horizontal reference plane, downward of approximately 45°.

The invented hinge is preferably fabricated from three such typical pool cover buoyant slats 11 preferably modified first by cutting off or removing the longitudinal, coupling prongs 13 along one longitudinal side of each slat as indicated by the dashed cut line 17 in FIG. 1. The longitudinal, coupling prongs 13 are chosen for removal rather the cooperating, female prong-receiving channels 14 in the illustrated case because the outside longitudinal sidewalls 18 of the flotation chambers 12 adjacent the longitudinal prongs 13 have rounded or contoured exterior corners, whereas the outside longitudinal sidewalls of the flotation chambers 12 adjacent the female, prong-receiving channels 14 have 'squared' exterior corners. Rounded or contoured outside longitudinal sidewalls are preferred over 'squared' outside longitudinal sidewalls for buoyant pool cover slats modified for fabricating the invented hinge, because the joined longitudinal sidewalls of the modified slats must pivot longitudinally adjacent to each other. Skilled pool cover designers and manufacturers should appreciate that cross-section configurations of walls dividing the different longitudinal tubular sections of inter-connecting, buoyant pool cover slat extrusions are determined by an extrusion die. Obviously, the tubular cross-section of the respective tubular sections of such extruded buoyant slats will differ between different manufacturers.

Figure 3:
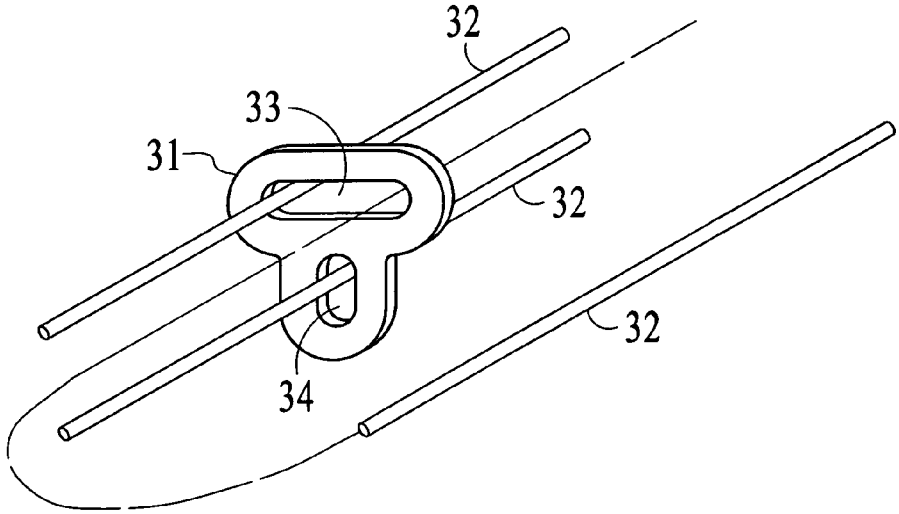
FIG. 3 is a perspective rendering illustrating the relationship of a hinge plate with coupling apertures and the longitudinal hinge pins passing through the hinge plate coupling apertures.
Figure 4:
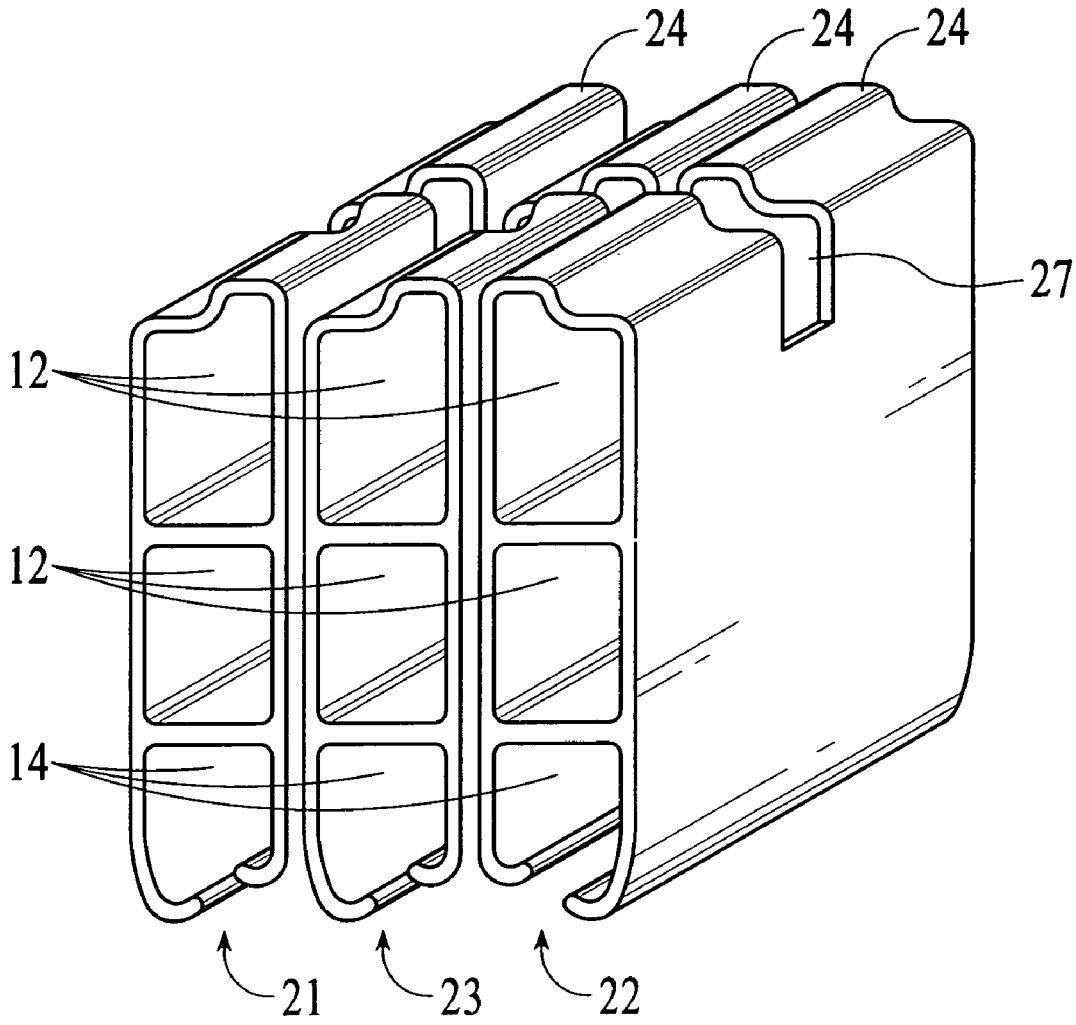
FIG. 4, illustrates in perspective, cutting of hinge bays simultaneously into the prong-side flotation chamber of three buoyant slats modified by having their longitudinal coupling prong removed.

Looking at FIG. 4, once the longitudinal prongs of the three buoyant slats 21, 22 and 23 have been removed, one of the slats 22 is rotated horizontally 180° and they are stacked or aligned adjacent each other with the prong-removed-side edges 24 facing the same direction. A series of uniformly spaced hinge bays 27 are then simultaneously cut perpendicularly into the prong-removed-side edges 24 penetrating to a uniform depth into the adjacent flotation chambers 12 of modified slats 21–23 as shown by dashed lines in FIGS. 5 and 6. The depth of the hinge bays 27 are determined by dimensions of apertured hinge plates 31 (see FIG. 3) to be located in the hinge bays 27. In particular, looking at FIGS. 5 and 6, the hinge bays 27 must be of sufficient depth to accommodate hinge plates 31 as modified slats 21 and 22 pivot from horizontal deployed positions floating at a pool surface (FIG. 5) to adjacent (vertically oriented) storing positions when wound into the cover roll around a cover drum (FIG. 6). Likewise, the thickness of the hinge plates 31 received in the hinge bays 27 determine the width of the hinge bays 27 cut into the prong-removed-side edges 24 of the modified slats 21–23. Loose as opposed to tight engagement is preferred.

The location of and spacing between hinge bays 27 depend on both aesthetics (appearance) and mechanical factors. In particular, it is necessary to preclude excessive longitudinal bending or deformation of the longitudinal components of the assembled hinge (the modified buoyant slats 21, 22, & 23 {FIGS. 5 & 6} and longitudinal hinge pins 32 {FIG. 3}) in light of tensile loading expected to be encountered due to buoyant forces on deployment/retraction of the pool cover sections, and when a fully deployed cover is tensioned and secured at the opposite ends of a pool for increasing surface load bearing capacity for safety. Generally hinges bays spaced approximately 18" apart, located 9" in from the edge of the pool cover at the hinge should provide sufficient tensile capacity to preclude such excessive longitudinal bending and deformation.

Figure 5:
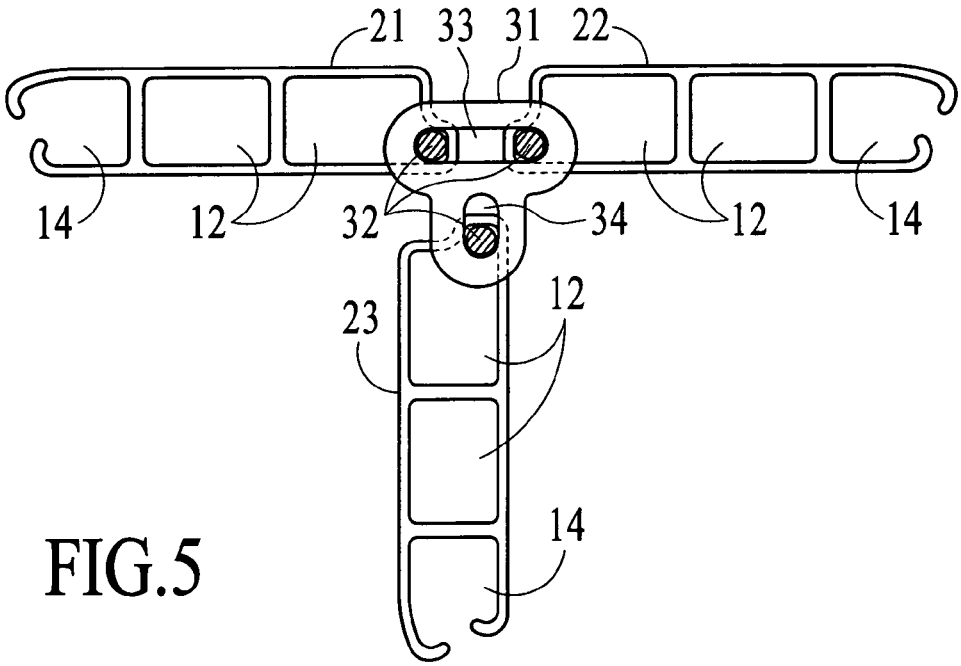
FIG. 5 illustrates in cross section cross section three angularly spaced parallel hinge axes and the three modified buoyant slat extrusions of the invented hinge oriented in its deployed configuration floating at a pool surface.
Figure 6:
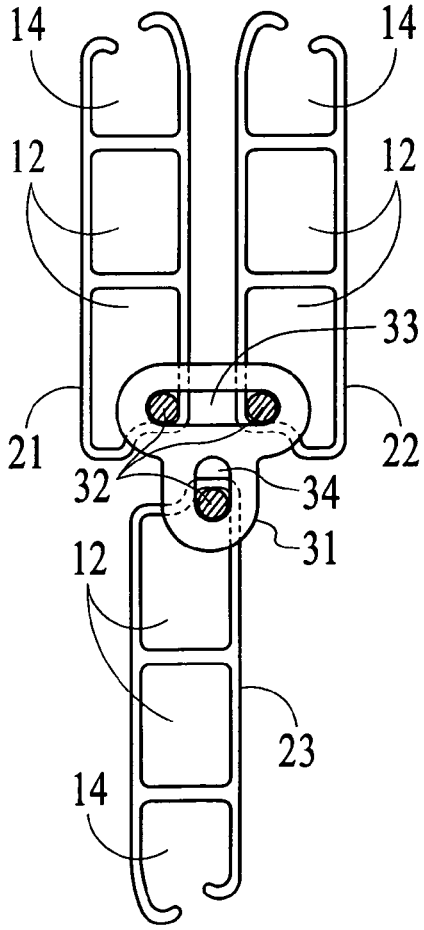
FIG. 6 illustrates in cross section cross section three angularly spaced parallel hinge axes and the three modified buoyant slat extrusions of the invented hinge oriented in its (vertically oriented) storing configuration when wound into the cover roll around a cover drum.
Figure 7:
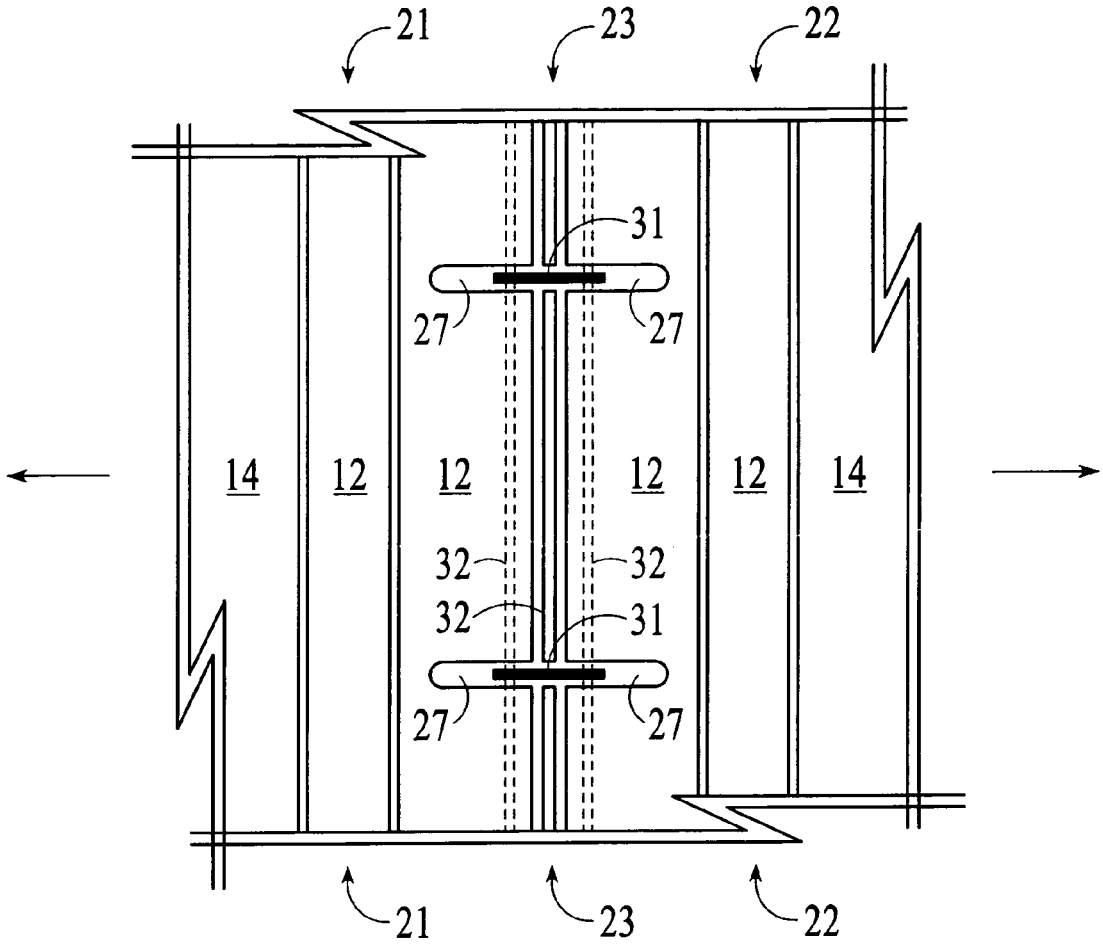
FIG. 7 is a partial top view of the invented hinge coupling two horizontal buoyant-slat pool cover sections deployed on a pool surface.

Looking at FIG. 3, each hinge plate 31 is appropriately sized in light of the width of the side edge and thickness of the sidewall of the prong-side floatation chamber of the particular extruded buoyant slats chosen for the pool cover (see FIGS. 5 & 6). The coupling aperture(s) 33 and 34 punched through the flat body of the hinge plates 31 are likewise sized, shaped and oriented to allow the particular three modified buoyant slats 21, 22 and 23 to freely pivot, longitudinally to positions adjacent each other when pinned together by the longitudinal hinge pins 32 passing through the coupling aperture(s) 33 & 34 inside of the respective prong-side flotation chambers 12 of the three modified slats 21, 22, & 23.

As illustrated in FIGS. 3, 5 & 6, the hinge plates 31 present an oblong horizontal lobe with a depending a vertical lobe. The lobes have a width approximately equal to the thickness of the particular buoyant slats chosen for the pool cover modified as described above. A horizontally oriented, coupling slot 33 with rounded ends is punched centrally through the horizontal lobe of the hinge plate 31, and a shorter, vertically oriented, coupling slot 34 is punched through the depending vertical lobe of the hinge plate 31. The diameter of the longitudinal hinge pins 32 establishes an accommodating greater width for the coupling slots 33 & 34. The respective lengths of the coupling slots 33 and 34 are specified to allow the coupled, modified buoyant slats 21, 22, & 23 to pivot and oscillate toward and away from each freely when floating mimicking the functionality and appearance of a conventional longitudinal prong/female prong-receiving channel coupling between the adjacent buoyant slats chosen for forming a pool cover After the hinge bays 27 are cut, a hinge plate 31 is then placed in each hinge bay 27 of modified buoyant slat 21 with a rounded end portion of the horizontally oriented coupling aperture 33 extending into the interior of prong-side flotation chamber 12 of slat 21. A first longitudinal hinge pin 32, inserted via the open the end of the prong-side flotation chamber 12 of modified buoyant slat 21, is then passed through the rounded end horizontal coupling aperture 33 of each hinge plate 31 received within each hinge bay 27 inside the flotation chamber 12 pinning the hinge plates 31 within the hinge bays 27 to modified buoyant slat 21.

Then 'horizontally rotated' modified slat 22 is aligned along side of the first modified buoyant slat with its hinge bays 27 receiving the hinge plates 31 pinned to modified buoyant slat 21 slat so that the opposite rounded end portion of the horizontal coupling slots 33 extend into the flotation chamber 12 of modified buoyant slat 22. A second longitudinal pin 32, similarly inserted via the open end of the prong-side flotation chamber 12 of modified buoyant slat 22, is passed through the opposite rounded portion of the coupling slot 33 of each hinge plate 31 received within each hinge bay 27 inside the flotation chamber 12 of modified buoyant slat 22 to pivotally couple the first and second modified buoyant slats together. It should be noted that rotating modified buoyant slat 22 horizontally 180° before the simultaneous cutting of the hinge bays switched the hand or parity of that slat so that the female-prong receiving channels sides of modified buoyant slats 21 & 22 are oppositely presented for interleaving onto the cooperating longitudinal coupling prong/structure 13 of the edge buoyant slats of two, preferably horizontal sections of a pool cover (see FIGS. 5 & 6).

The third so modified buoyant slat 23 is then aligned adjacent along the juncture of the pinned together modified buoyant slats 21 & 22 with its spaced hinge bays 27 also receiving the hinge plates 31, this time with a rounded end portion of the vertically oriented coupling slot 34 extending into the prong-side flotation chamber 12 of the third modified buoyant slat 23. A third longitudinal pin 32, similarly inserted via the open end of the prong-side flotation chamber 12 of the third modified buoyant slat 23 is passed through the rounded end portion of the vertically oriented coupling slots 34 of the hinge plates 31 inside of the flotation chamber 12 of the third modified buoyant slat 23, pivotally coupling the first, second and third modified buoyant slats 21, 22, & 23 together. It should be noted that modified buoyant slat 23 has the same hand or parity as modified buoyant slat 21 so that its female prong-receiving channel 14 is presented for coupling onto the cooperating longitudinal coupling prong/structure 13 of an edge buoyant slat of preferably, a vertical section of a pool cover (see FIGS. 5 & 6).

Upon being assembled, the invented hinge provides a pivotal coupling with three angularly spaced, parallel hinge axes, adapted to be coupled, by the remaining longitudinal female prong-receiving channels of the three so modified, longitudinal buoyant slats, to three separate buoyant-slat pool cover sections that can deploy and retract in three different directions, with each pool cover section independently pivotable about a separate, angular spaced, but parallel axis aligned with the longitudinal slats forming the cover.

After assembly, the open ends of the flotation chambers of the three modified buoyant slats forming the hinge are closed or stoppered (See U.S. Pat. No. 5,732,846, Helge). Plugs may also be inserted or formed within the longitudinal (prong-side) flotation chambers 12 of the modified buoyant slats 21, 22 & 23 sandwiching the hinge bays 27 to trap air within the chambers between the bays 27 if is necessary to increase the buoyancy of the invented hinge. Alternatively, filling the compromised prong-side flotation chambers 12 of the so modified buoyant slats 21, 22, & 23 with buoyant sealant foam can increase buoyancy of the so modified buoyant slats. In addition to increasing buoyancy, post assembly, hinge bay plugs, sealant foam or combination thereof, would help anchor the longitudinal hinge pins 31 within the respective flotation chambers 12 of the coupled hinge slats.

The invented hinge and associated techniques for fabricating it from typical extruded buoyant slats for buoyant-slat pool cover systems have been described in context of both representative and preferred embodiments which have reference to automatic swimming pool cover systems invented and developed by the Applicant and others. [See Applicant's co-pending application Ser. No. 09/829,801 filed Apr. 10, 2001 entitled AUTOMATIC POOL COVER SYSTEM USING BUOYANT-SLAT POOL COVERS.] It should be recognized that skilled engineers and designers could specify different configurations for the described mechanisms implementing the invented hinge and steps for fabricating it that perform substantially the same function, in substantially the same way to achieve substantially the same result as those components and fabrication steps described and specified in this application. Similarly, the respective elements described for effecting the functionality described in this application could be configured differently, per constraints imposed by different mechanical components, yet perform substantially the same function, in substantially the same way to achieve substantially the same result as those components described and specified by the Applicant above. Accordingly, while mechanical components suitable for and the steps for fabricating the invented hinge may not be exactly as described herein, they will fall within the spirit and the scope of invention as described and set forth in the appended claims.

I claim:

1. An invented hinge coupling three buoyant-slats pool cover sections together comprising in combination, a) at least three adjacent, aligned, longitudinal, hinge slats having uniformly spaced, and registering hinge bays perpendicularly cut into one longitudinal side of each slat, and having a longitudinal, cooperating coupling means on a side opposite the hinge bays for coupling to a complementary longitudinal cooperating coupling means on a side of an end buoyant slat of a buoyant-slat pool cover section, each hinge bay penetrating though a wall of a longitudinal side flotation chamber of the particular hinge slat;

b) hinge plates each having coupling apertures, each being received within the registering hinge bays of the three, adjacent and aligned longitudinal hinge slats with a portion of the coupling aperture extending beyond the walls inside each of the side floatation chambers of the three adjacent, aligned hinge slats;

c) at least three longitudinal hinge pins each located inside the side flotation chamber of one of the hinge slats penetrated by the hinge bays, each hinge pin passing through the portion of coupling aperture of all the hinge plates extending beyond the wall inside of the side floatation chambers pining the three, adjacent and aligned hinge slats together for pivoting about three, angularly spaced, longitudinal axes parallel to the hinge slats established by the longitudinal pins.

2. A method for fabricating a hinge for coupling three buoyant-slat pool cover sections together from three longitudinal, buoyant, pool cover slats wherein each slat has different cooperating coupling means extending longitudinally along opposite sides of the slat each for coupling with the different cooperating coupling means of an adjacent slat for forming a pool cover section, comprising the steps of:

a) removing one of the cooperating coupling means extending longitudinally along one side of at least three of the longitudinal, buoyant, pool cover slats;

b) cutting uniformly spaced hinge bays perpendicularly penetrating into a side, longitudinal flotation chamber of each of the three pool cover slats on the side of those slats from which the cooperating coupling means has been removed;

c) placing a hinge plate having coupling apertures into each uniformly spaced hinge bay cut into the side of a first one of the three pool cover slats with its coupling aperture extending inside the side flotation chamber of such first slat;

d) inserting a first longitudinal hinge pin inside the side flotation chamber of the first of the three pool cover slats passing it through the coupling apertures of the hinge plates received in its uniformly spaced hinge bays pining the hinge plates and the first of the three pool cover slats together providing a first hinge axis;

e) aligning a second of the three pool cover slats along side the first of those slats with its uniformly, spaced hinge bays receiving the hinge plates pinned to the first slat and with the coupling apertures of the hinge plates extending inside of the side flotation chamber of such second slat;

f) inserting a second longitudinal hinge pin inside the side flotation chamber of the second of the three pool cover slats also passing it through the coupling apertures of the hinge plates received in its uniformly spaced hinge bays pining the hinge plates and the first and second of the three pool cover slats together for providing a second hinge axis parallel and essentially coplanar with the first hinge axis;

g) aligning a third of the three pool cover slats along the pinned together first and second of those slats with its uniformly, spaced hinge bays also receiving the hinge plates pining the first and second slats together with the coupling apertures of the hinge plates extending inside of the side flotation chamber of such third slat;

h) inserting a third longitudinal hinge pin inside the side flotation chamber of the third of the three pool cover slats passing it through the coupling apertures of the hinge plates received in its uniformly spaced hinge bays pining the hinge plates and the first, second, and third of the three pool cover slats together providing a third hinge axis parallel and vertically spaced from the plane of the first and second hinge axes;

whereby, separate pool cover sections can be coupled to each of the remaining cooperating coupling means extending longitudinally along one side of each of three of the longitudinal, buoyant, pool cover slats pinned together by the hinge plates and longitudinal pins forming a hinge.

* * * * *